US006494320B1

(12) United States Patent
Schmidt et al.

(10) Patent No.: US 6,494,320 B1
(45) Date of Patent: Dec. 17, 2002

(54) GOLF BAG STAND

(75) Inventors: Gregory J. Schmidt, Glendale, AZ (US); John A. Solheim, Phoenix, AZ (US); Douglas R. Hawken, Cave Creek, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

(21) Appl. No.: 09/954,312

(22) Filed: Sep. 17, 2001

(51) Int. Cl.[7] ..... A63B 55/00; A63B 55/06

(52) U.S. Cl. ..... 206/315.7; 206/315.3; 248/96

(58) Field of Search ..... 248/96; 211/70.2; 206/315.3, 315.5, 315.6, 315.7, 315.8; D3/255

(56) References Cited

U.S. PATENT DOCUMENTS 2,007,709 A * 7/1935 Eppens ..... 248/96
2,621,799 A * 12/1952 Wilson ..... 248/96 X
2,628,801 A 2/1953 Gunning
4,054,256 A * 10/1977 Buck, Jr. et al. ..... 248/96
4,834,235 A 5/1989 Solheim
5,096,148 A * 3/1992 Quellais et al. ..... 248/96
5,228,566 A * 7/1993 Shenoha ..... 206/315.7 X
5,730,285 A * 3/1998 Sheehan ..... 206/315.3
5,875,943 A * 3/1999 Frandsen, Sr. ..... 248/96 X

FOREIGN PATENT DOCUMENTS

WO 9921621 * 5/1999

* cited by examiner

*Primary Examiner*—Sue A. Weaver
(74) *Attorney, Agent, or Firm*—Darrell F. Marquette

(57) ABSTRACT

A golf bag stand includes a saddle shaped member which is secured to a generally tubular body of a golf bag. A leg member extends from the saddle shaped member in a direction which is generally normal to the longitudinal axis of the golf bag body. Since the leg member is fixed relative to the saddle shaped member, no actuation of the leg member is required in order for the leg member to support the golf bag body in a propped up position when the golf bag is resting on the ground. The leg member is bifurcated so that a pair of feet are formed on an outer end thereof.

5 Claims, 2 Drawing Sheets

GOLF BAG STAND

BACKGROUND OF THE INVENTION

This invention relates generally to golf equipment and, in particular, to a stand for propping up a golf bag.

U.S. Pat. No. 4,834,235 to J. A. Solheim et al discloses a golf bag with an extensible stand for supporting the golf bag in a propped up attitude. The stand is movable between an extended position and a retracted position by actuation of a toggle mechanism. The stand includes a pair of legs pivotally attached to the golf bag body adjacent its open top end. The toggle mechanism includes an actuator rod which is pivotally connected to the golf bag body and to the legs for moving the legs between their extended and retracted positions. While the stand disclosed in the Solheim et al patent operates satisfactorily, its pivoting legs and toggle mechanism add complexity to the golf bag and increase manufacturing costs.

SUMMARY OF THE INVENTION

The present invention provides a stand for use in combination with a golf bag wherein the golf bag has a generally tubular body with a longitudinal axis, a relatively rigid sidewall and an open top end. The stand includes a saddle shaped member and a leg member. The saddle shaped member is secured to the body sidewall proximate the open top end of the body, and the leg member extends from the saddle shaped member in a direction which is generally normal to the longitudinal axis of the body. Since the leg member is fixed relative to the saddle shaped member, no actuation of the leg member is required in order for the leg member to support the body in a propped up position when the golf bag is resting on the ground. The leg member has an inner end joined to the saddle shaped member, and the leg member is bifurcated so that a pair of legs are formed on an outer end thereof.

DESCRIPTION OF THE PREFERRED EMBODIMENT

Figure 1:
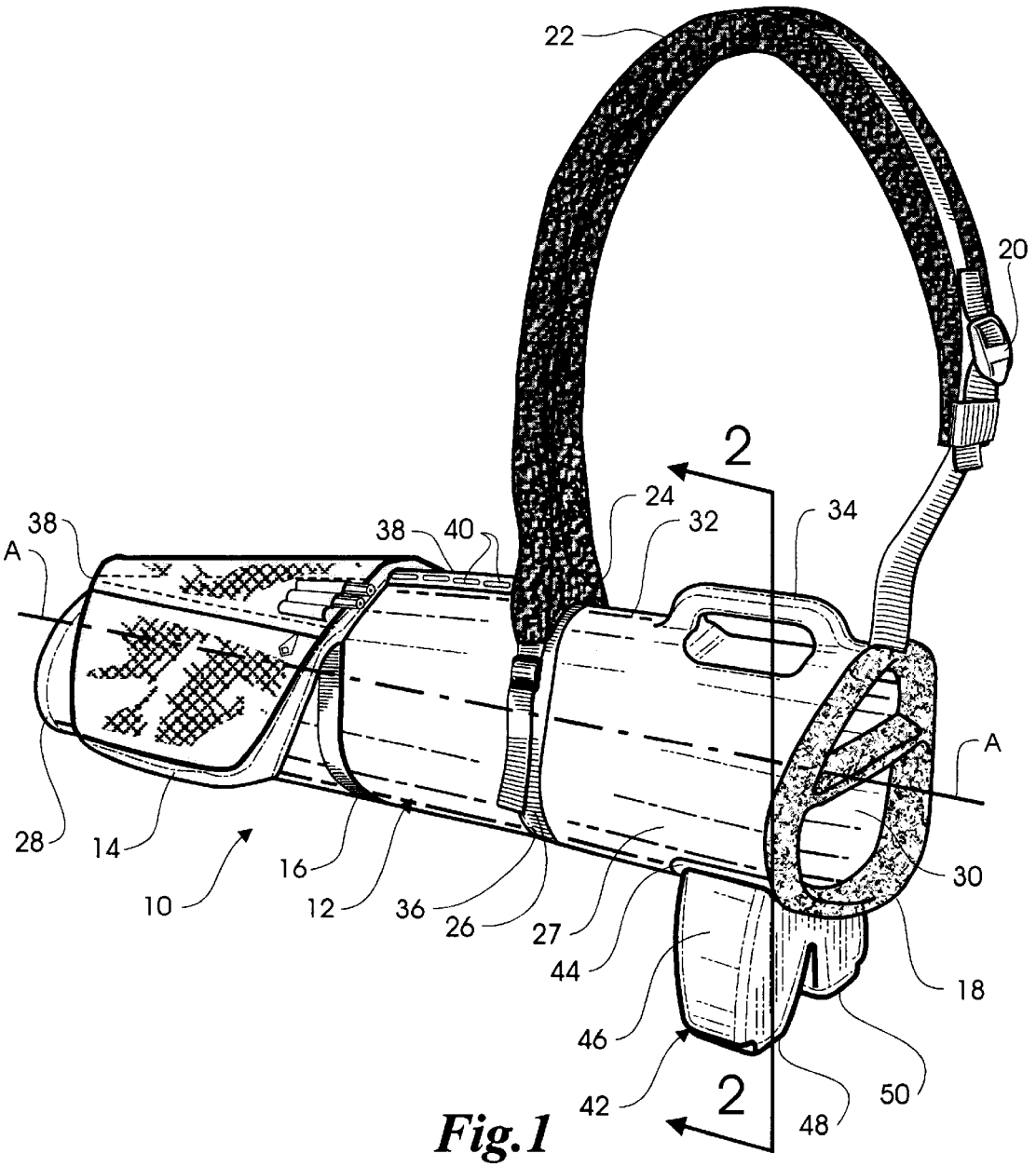
FIG. 1 is a perspective view of a golf bag incorporating a stand in accordance with the present invention.

Referring to the drawings, FIG. 1 shows a golf bag which is indicated generally by the reference numeral 10. The golf bag 10 includes a generally tubular body 12, a pocket assembly 14 for carrying accessories used in playing golf such as golf balls, tees and the like. The pocket assembly 14 may be removably attached to the body 12 by a pair of straps 16 (only one of which is shown). The body 12 has a protective collar 18 attached thereto with the collar 18 having an upper end 20 of a shoulder strap 22 coupled thereto. A lower end 24 of the shoulder strap 22 is coupled to the body 12 by an attachment strap 26.

The body 12 is an elongated unitary structure having a sidewall 27, a closed bottom end 28 and an open top end 30. The body 12 preferably has a generally ovoid cross sectional shape so that a relatively small radius portion of the ovoid shape provides a ridge 32 which extends generally longitudinally of the body 12. a handle 34 is integrally formed on and along one side of the body 12 so as to extend therefrom in a plane that is substantially perpendicular to the longitudinal axis A of the body 12. The handle 34 is positioned on the ridge 32 proximate the open top 30 of the body 12. An annular groove 36 is formed in the body 12 for receiving the attachment strap 26 of the shoulder strap 22 to prevent longitudinal movement of the shoulder strap lower end 24 when the shoulder strap 22 is coupled to the body 12 in the manner shown in FIG. 1.

A connector device is provided on the lower end 24 of the shoulder strap 22 and on the body 12 so that the shoulder strap 22 will extend normally from the body 12 in substantially the same plane as the handle 34. When the golf bag 10 is resting on the ground in the propped up H position as shown in FIG. 1, the shoulder strap 22 will be disposed in an upwardly extending position so that, without bending over, a golfer may pick up the golf bag 10 from the propped up position of FIG. 1. The shoulder strap 22 has a bifurcated shape on its lower end 24 so that the lower end 24 straddles the ridge 32 on the body 12.

The body 12 also includes an upstanding rib 38 which extends from proximate the closed bottom end 28 toward the open top end 30. The rib 38 extends from the body 12 in the same direction as the handle 34 and the shoulder strap 22, and is provided with a plurality of slots 40 therein. The rib 38 provides rigidity to the body 12 and functions to attach the pocket assembly 14 to the body 12. It will be understood that since the body 12 is preferably molded of synthetic resin, the sidewall 27 is relatively rigid.

In accordance with the present invention, the golf bag 10 is provided with a stand 42 for supporting the body 12 in a propped up position shown in FIG. 1 when the golf bag 10 is resting on the ground. Thus, the open top end 30 of the body 12 and the protruding golf club heads (not shown) will be located far enough above the ground to avoid contamination thereof from wet grass or mud.

Figure 2:
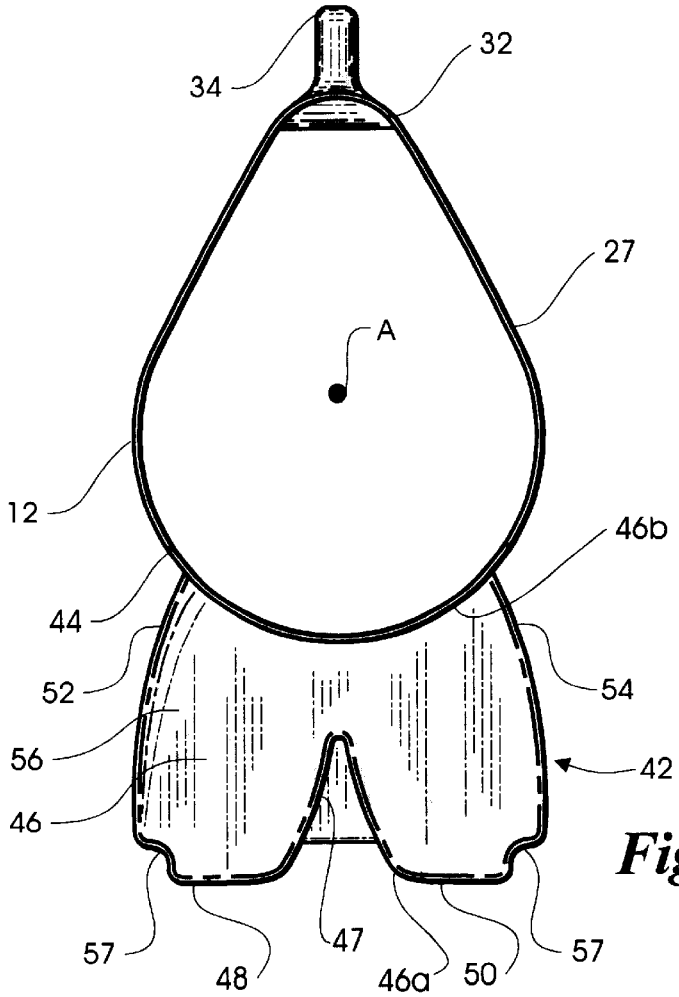
FIG. 2 is an enlarged sectional view taken along the lines 2—2 in FIG. 1.
Figure 3:
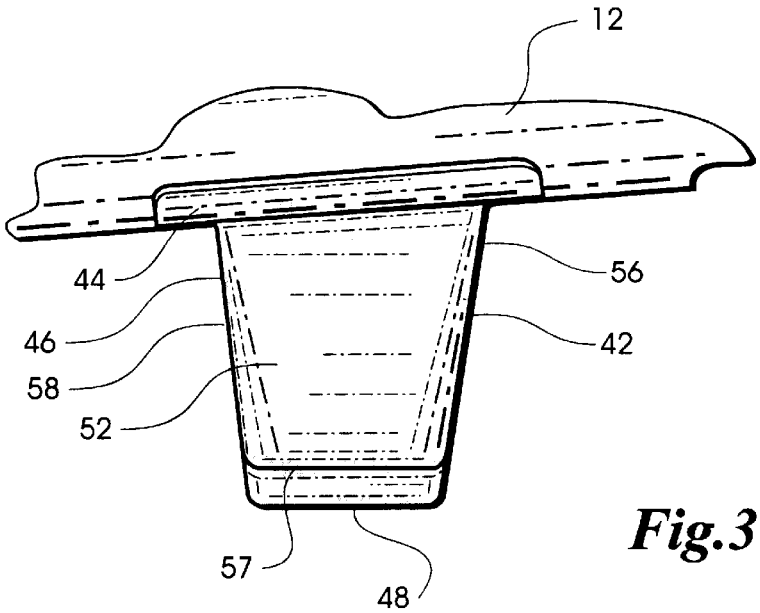
FIG. 3 is a side elevational view showing a portion of the golf bag with the stand attached thereto.

As seen best in FIGS. 2 and 3, the stand 42 includes a saddle shaped member 44 that mates with an arcuate portion of the body sidewall 27 proximate the open top end 30 of the body 12 and opposite the handle 34. The saddle shaped member 44 is secured to the body sidewall 27 by using adhesive or fasteners (not shown) such as rivets. A leg member 46 extends from the saddle shaped member 44 in a direction which is generally normal to the longitudinal axis a of the body 12. Since the leg member 46 is fixed relative to the saddle shaped member 44, no actuation of the leg member 46 is required in order for the leg member 46 to support the body 12 in its propped up position.

The leg member 46 is bifurcated at 47 to form a pair of feet 48 and 50 on an outer end 46*a* of the leg member 46. An inner end 46*b* of the leg member 46 is joined to the saddle shaped member 44. The feet 48, 50 are spaced apart for engaging the ground when the golf bag 10 is resting on the ground as shown in FIG. 1. The leg member 46 has a pair of side panels 52, 54 which are each provided with a notch 57 adjacent the outer end 46*a* of the leg member 46 so that the feet 48, 50 are recessed inwardly toward each other and away from the side panels 52, 54. The leg member 46 also has a front panel 56 and a rear panel 58, and the side panels 52, 54 extend between the front and rear panels 56, 58.

When the golf bag 10 is being carried, one of the side panels 52, 54 of the leg member 46 may contact the clothing of the person carrying the golf bag 10 but with the feet 48, 50 recessed inwardly as described above, they will be held in spaced relationship with respect to the person's clothing. Thus, any moisture or dirt that may accumulate on the feet

48, 50 will be prevented from contaminating the clothing of the person carrying the golf bag 10. The saddle shaped member 44 and the leg member 46 may be molded of synthetic resin and are preferably integrally formed with respect to each other so that the stand 42 is a unitary structure.

What is claimed is:

1. In combination with a golf bag having a generally tubular body with a sidewall and an open top end, a stand comprising:

a saddle shaped member secured to said sidewall of said body proximate said open top end;

a leg member extending from said saddle shaped member, said leg member being fixed relative to said saddle shaped member thereby requiring no actuation of said leg member in order for said leg member to support said body in a propped up position when the golf bag is resting on the ground;

said leg member being bifurcated so that a pair of feet are formed on an outer end of said leg member; and said leg member having a pair of side panels each of which is provided with a notch adjacent the outer end of said leg member so that said pair of feet are recessed inwardly toward each other and away from said pair of side panels.

2. In the combination of claim 1, wherein said body includes a handle formed on said sidewall opposite said stand.

3. In the combination of claim 1, wherein said leg member has an inner end joined to said saddle shaped member.

4. In the combination of claim 1, wherein said leg member has a front panel and a rear panel, and wherein said side panels extend between said front and rear panels.

5. In combination with a golf bag having a generally tubular body with a longitudinal axis, a relatively rigid sidewall and an open top end, a stand comprising:

a saddle shaped member secured to said sidewall of said body proximate said open top end, said saddle shaped member mating with an arcuate portion of said body sidewall;

a leg member extending from said saddle shaped member in a direction which is generally normal to the longitudinal axis of said body, said leg member being fixed relative to said saddle shaped member thereby requiring no actuation of said leg member in order for said leg member to support said body in a propped up position when the golf bag is resting on the ground;

said leg member having an inner end joined to said saddle shaped member, said leg member being bifurcated so that a pair of feet are formed on an outer end thereof; and said leg member having a pair of side panels each of which is provided with a notch adjacent the outer end of said leg member so that said pair of feet are recessed inwardly toward each other and away from said pair of side panels.

* * * * *